US007630890B2

(12) United States Patent
Son et al.

(10) Patent No.: US 7,630,890 B2
(45) Date of Patent: Dec. 8, 2009

(54) BLOCK-CONSTRAINED TCQ METHOD, AND METHOD AND APPARATUS FOR QUANTIZING LSF PARAMETER EMPLOYING THE SAME IN SPEECH CODING SYSTEM

(75) Inventors: Chang-yong Son, Seoul (KR); Sang-won Kang, Gyeonggi-do (KR); Yong-won Shin, Daegu-si (KR); Thomas R. Fischer, Seattle, WA (US)

(73) Assignee: Samsung Electronics Co., Ltd., Suwon-Si (KR)

( * ) Notice: Subject to any disclaimer, the term of this patent is extended or adjusted under 35 U.S.C. 154(b) by 1132 days.

(21) Appl. No.: 10/780,899

(22) Filed: Feb. 19, 2004

(65) Prior Publication Data

US 2004/0230429 A1 Nov. 18, 2004

(30) Foreign Application Priority Data

Feb. 19, 2003 (KR) ..... 10-2003-0010484

(51) Int. Cl.
*G10L 19/00* (2006.01)
*G10L 19/12* (2006.01)

(52) U.S. Cl. ..... 704/230; 704/219; 704/222

(58) Field of Classification Search ..... None
See application file for complete search history.

(56) References Cited

U.S. PATENT DOCUMENTS 5,744,846 A * 4/1998 Batra et al. ..... 257/380
5,774,839 A * 6/1998 Shlomot ..... 704/222
5,826,225 A * 10/1998 Hartung et al. ..... 704/222

(Continued)

OTHER PUBLICATIONS

Kuo et al, "Low bit-rate quantization of LSP parameters using two-dimensionaldifferential coding",1992 IEEE International Conference on Acoustics, Speech, and Signal Processing. ICASSP-92., Mar. 23-26, vol. 1, pp. 97-100.*

(Continued)

*Primary Examiner*—Matthew J Sked
(74) *Attorney, Agent, or Firm*—Staas & Halsey LLP

(57) ABSTRACT

A block-constrained Trellis coded quantization (TCQ) method and a method and apparatus for quantizing line spectral frequency (LSF) parameters employing the same in a speech coding system wherein the LSF coefficient quantizing method includes: removing the direct current (DC) component in an input LSF coefficient vector; generating a first prediction error vector by performing inter-frame and intra-frame prediction for the LSF coefficient vector, in which the DC component is removed, quantizing the first prediction error vector by using the BC-TCQ algorithm, and by performing intra-frame and inter-frame prediction compensation, generating a quantized first LSF coefficient vector; generating a second prediction error vector by performing intra-frame prediction for the LSF coefficient vector, in which the DC component is removed, quantizing the second prediction error vector by using the BC-TCQ algorithm, and then, by performing intra-frame prediction compensation, generating a quantized second LSF coefficient vector; and selectively outputting a vector having a shorter Euclidian distance to the input LSF coefficient vector between the generated quantized first and second LSF coefficient vectors.

21 Claims, 13 Drawing Sheets

U.S. PATENT DOCUMENTS

| | | | | |
|---|---|---|---|---|
| 6,125,149 | A * | 9/2000 | Jafarkhani et al. | 375/262 |
| 6,148,283 | A * | 11/2000 | Das | 704/222 |
| 6,269,333 | B1 | 7/2001 | Ravishankar | 704/243 |
| 6,622,120 | B1 * | 9/2003 | Yoon et al. | 704/222 |
| 6,625,224 | B1 * | 9/2003 | Gotting et al. | 375/265 |
| 6,697,434 | B1 * | 2/2004 | Kim | 375/245 |
| 6,988,067 | B2 * | 1/2006 | Kim et al. | 704/222 |
| 2005/0086577 | A1 * | 4/2005 | Sipil et al. | 714/792 |

OTHER PUBLICATIONS

Shoham, Yair, "Coding the line spectral frequencies by jointly optimized MAprediction and vector quantization", 1999 IEEE Workshop on Speech Coding Proceedings, Jun. 20-23, 1999, pp. 46-48.*

Nikneshan, S. et al, "Soft Decision Decoding of a fixed-rate Entropy-coded Trellis Quantizer over a noisy Channel", Department of Electrical and Computer Engineering, University of Waterloo, Technical Report, Sep. 2, 2001, pp. 1-20.*

Eriksson, Thomas et al, "Interfreame LSF Quantization for Noisy Channels", IEEE Transactions on Speech and Audio Procesing, Sep. 1999, vol. 7, No. 5, pp. 495-509.*

Erzin, Engin et al, "Interframe Differential Vector Coding of Line Spectrum Frequencies" 1993 IEEE International Conference on Acoustics, Speech and Signal Processing, ICASSP 93, Apr 27-30, vol. 2, pp. 25-28.*

Lahouti, et al. "Quantization of line spectral parameters using a trellis structure" Proceedings of 2000 Internation Conference on Acoustics, Speech and Signal Processing, vol. 5 p. 2781-4.*

Pan et al. "Vector quantization of speech LSP parameters using trellis codes and |/sub 1/-norm constraints" 1993 International Conference on Acoustics, Speech and Signal Processing, vol. 2, p. 17-20.*

Malone K. T. et al., "Trellis-Searched Adaptive Predictive Coding," Globecom 88, IEEE Global Telecommunications Conference And Exhibition, New York, NY, Nov. 28, 1988, pp. 566-570.

* cited by examiner

BLOCK-CONSTRAINED TCQ METHOD, AND METHOD AND APPARATUS FOR QUANTIZING LSF PARAMETER EMPLOYING THE SAME IN SPEECH CODING SYSTEM

CROSS-REFERENCE TO RELATED APPLICATIONS

This application claims priority from Korean Patent Application No. 2003-10484, filed Feb. 19, 2003, in the Korean Industrial Property Office, the disclosure of which is incorporated herein by reference.

BACKGROUND OF THE INVENTION

1. Field of the Invention

The present invention relates to a speech coding system, and more particularly, to a method and apparatus for quantizing line spectral frequency (LSF) using block-constrained Trellis coded quantization (BC-TCQ).

2. Description of the Related Art

For high quality speech coding in a speech coding system, it is very important to efficiently quantize linear predictive coding (LPC) coefficients indicating the short interval correlation of a voice signal. In an LPC filter, an optimal LPC coefficient value is obtained such that after an input voice signal is divided into frame units, the energy of the prediction error for each frame is minimized. In the third generation partnership project (3GPP), the LPC filter of an adaptive multi-rate wideband (AMR_WB) speech coder standardized for International Mobile Telecommunications-2000 (IMT-2000) is a 16-dimensional all-pole filter and at this time, for quantization of 16 LPC coefficients being used, many bits are allocated. For example, the IS-96A Qualcomm code excited linear prediction (QCELP) coder, which is the speech coding method used in the CDMA mobile communications system, uses 25% of the total bits for LPC quantization, and Nokia's AMR_WB speech coder uses a maximum of 27.3% to a minimum of 9.6% of the total bits in 9 different modes for LPC quantization.

So far, many methods for efficiently quantizing LPC coefficients have been developed and are being used in voice compression apparatuses. Among these methods, direct quantization of LPC filter coefficients has the problems that the characteristic of a filter is too sensitive to quantization errors, and stability of the LPC filter after quantization is not guaranteed. Accordingly, LPC coefficients should be converted into other parameters having a good compression characteristic and then quantized and reflection coefficients or LSFs are used. Particularly, since an LSF value has a characteristic very closely related to the frequency characteristic of voice, most of the recently developed voice compression apparatuses employ a LSF quantization method.

In addition, if inter-frame correlation of LSF coefficients is used, efficient quantization can be implemented. That is, without directly quantizing the LSF of a current frame, the LSF of the current frame is predicted from the LSF information of past frames and then the error between the LSF and its prediction frames is quantized. Since this LSF value has a close relation with the frequency characteristic of a voice signal, this can be predicted temporally and in addition, can obtain a considerable prediction gain.

LSF prediction methods include using an auto-regressive (AR) filter and using a moving average (MA) filter. The AR filter method has good prediction performance, but has a drawback that at the decoder side, the impact of a coefficient transmission error can spread into subsequent frames. Although the MA filter method has prediction performance that is typically lower than that of the AR filter method, the MA filter has an advantage that the impact of a transmission error is constrained temporally. Accordingly, speech compression apparatuses such as AMR, AMR_WB, and selectable mode vocoder (SMV) apparatuses that are used in an environment where transmission errors frequently occur, such as wireless communications, use the MA filter method of predicting LSF. Also, prediction methods using correlation between neighbor LSF element values in a frame, in addition to LSF value prediction between frames, have been developed. Since the LSF values must always be sequentially ordered for a stable filter, if this method is employed additional quantization efficiency can be obtained.

Quantization methods for LSF prediction error can be broken down into scalar quantization and vector quantization (VQ). At present, the vector quantization method is more widely used than the scalar quantization method because VQ requires fewer bits to achieve the same encoding performance. In the vector quantization method, quantization of entire vectors at one time is not feasible because the size of the VQ codebook table is too large and codebook searching takes too much time. To reduce the complexity, a method by which the entire vector is divided into several sub-vectors and each sub-vector is independently vector quantized has been developed and is referred to as a split vector quantization (SVQ) method. For example, if in 10-dimensional vector quantization using 20 bits, quantization is performed for the entire vector, the size of the vector codebook table becomes $10\times2^{20}$. However, if a split vector quantization method is used, by which the vector is divided into two 5-dimensional sub-vectors and 10 bits are allocated for each sub-vector, the size of the vector table becomes just $5\times2^{10}\times2$.

FIG. 1A shows an LSF quantizer used in an AMR wideband speech coder having a multi-stage split vector quantization (S-MSVQ) structure, and FIG. 1B shows an LSF quantizer used in an AMR narrowband speech coder having an SVQ structure. In LSF coefficient quantization with 46 bits allocated, compared to a full search vector quantizer, the LSF quantizer having an S-MSVQ structure as shown in FIG. 1A has a smaller memory and a smaller amount of codebook search computation, but due to complexity of memory and codebook search, requires a larger amount of computation. Also, in the SVQ method, if the vector is divided into more sub-vectors, the size of the vector table decreases and the memory can be saved and search time can decrease, but the performance is degraded because the correlation between vector values is not fully utilized. In an extreme case, if 10-dimensional vector quantization is divided into 10 1-dimensional vectors, it becomes scalar quantization. If the SVQ method is used and without LSF prediction between 20 msec frames, LSF is directly quantized, and acceptable quantization performance can be obtained using 24 bits per vector. However, since in the SVQ method each sub-vector is independently quantized, correlation between sub-vectors cannot be fully utilized and the entire vector cannot be optimized.

Many VQ methods have been developed including a method by which vector quantization is performed in a plurality of operations, a selective vector quantization method by which two tables are used for selective quantization, and a link split vector quantization method by which a table is selected by checking a boundary value of each sub-vector.

These methods of LSF quantization can provide transparent sound quality, provided the encoding rate is large enough.

SUMMARY OF THE INVENTION

The present invention also provides an apparatus and method by which by applying the block-constrained Trellis coded quantization method, line spectral frequency coefficients are quantized.

According to an aspect of the present invention, there is provided a block-constrained (BC)-Trellis coded quantization (TCQ) method including: in a Trellis structure having total N ($N=2^v$, here v denotes the number of binary memory elements in the finite-state machine defining the convolutional encoder) states, constraining the number of initial states of Trellis paths available for selection, within $2^k$ ($0 \leqq k \leqq v$) in total N states, and constraining the number of the states of a last stage within $2^{v-k}$ among total N states according to the initial states of Trellis paths; after referring to initial states of N survivor paths determined under the initial state constraint by the constraining from a first stage to stage $L-\log_2 N$ (here, L denotes the number of the entire stages and N denotes the number of entire Trellis states), considering Trellis paths in which the state of a last stage is selected among $2^{v-k}$ states determined by each initial state under the constraint that the state of a last stage is constrained by the remaining v stages; and obtaining an optimum Trellis path among the considered Trellis paths and transmitting the optimum Trellis path.

According to another aspect of the present invention, there is provided a line spectral frequency (LSF) coefficient quantization method in a speech coding system comprising: removing the direct current (DC) component in an input LSF coefficient vector; generating a first prediction error vector by performing inter-frame and intra-frame prediction of the LSF coefficient vector, in which the DC component is removed, quantizing the first prediction error vector by using BC-TCQ algorithm, and then, by performing intra-frame and inter-frame prediction compensation, generating a quantized first LSF coefficient vector; generating a second prediction error vector by performing intra-frame prediction of the LSF coefficient vector, in which the DC component is removed, quantizing the second prediction error vector by using the BC-TCQ algorithm, and then, by performing intra-frame prediction compensation, generating a quantized second LSF coefficient vector; and selectively outputting a vector having a shorter Euclidian distance to the input LSF coefficient vector between the generated quantized first and second LSF coefficient vectors.

According to still another aspect of the present invention, there is provided an LSF coefficient quantization apparatus in a speech coding system comprising: a first subtracter which removes the DC component in an input LSF coefficient vector and provides the LSF coefficient vector, in which the DC component is removed; a memory-based Trellis coded quantization unit which generates a first prediction error vector by performing inter-frame and intra-frame prediction for the LSF coefficient vector provided by the first subtracter, in which the DC component is removed, quantizes the first prediction error vector by using the BC-TCQ algorithm, and then, by performing intra-frame and inter-frame prediction compensation, generates a quantized first LSF coefficient vector; a non-memory Trellis coded quantization unit which generates a second prediction error vector by performing intra-frame prediction for the LSF coefficient vector, in which the DC component is removed, quantizes the second prediction error vector by using BC-TCQ algorithm, and then, by performing intra-frame prediction compensation, generates a quantized second LSF coefficient vector; and a switching unit which selectively outputs a vector having a shorter Euclidian distance to the input LSF coefficient vector between the quantized first and second LSF coefficient vectors provided by the memory-based Trellis coded quantization unit and the non-memory-based Trellis coded quantization unit, respectively.

Additional aspects and/or advantages of the invention will be set forth in part in the description which follows, and, in part, will obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1A:
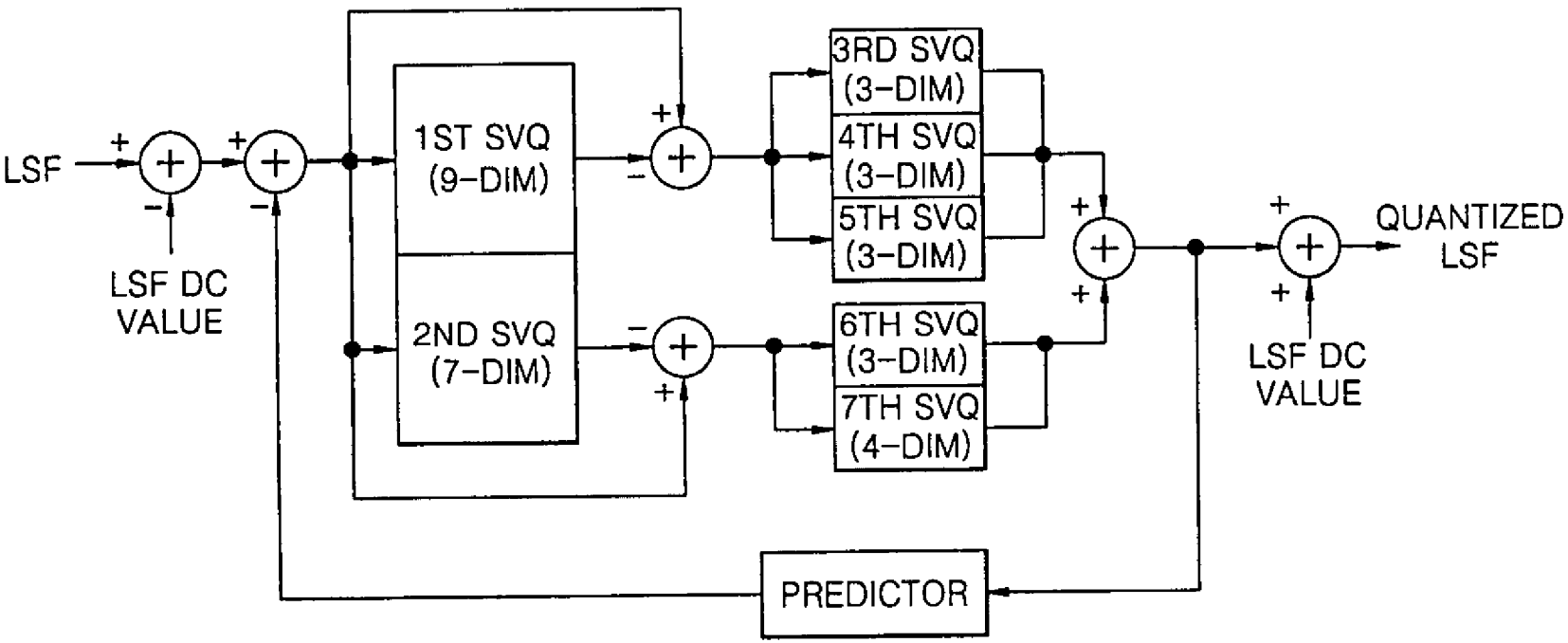
FIG. 1A (PRIOR ART)
FIGS. 1A and 1B are block diagrams of quantizers applied to adaptive multi rate (AMR) wideband and narrowband speech coders proposed by 3rd generation partnership project (3GPP)
Figure 1B:
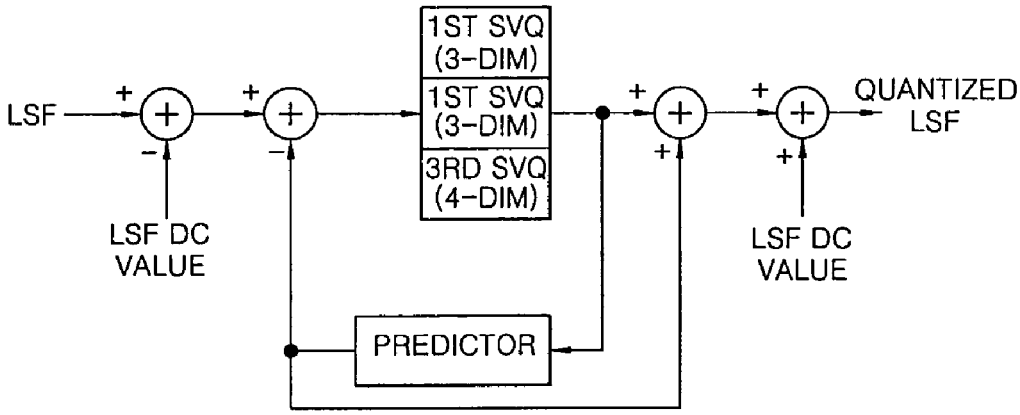
FIG. 1B (PRIOR ART)

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Prior to detailed explanation of the present invention, the Trellis coded quantization (TCQ) method will now be explained.

While ordinary vector quantizers require a large memory space and a large amount of computation, the TCQ method is characterized in that it requires a smaller memory size and a smaller amount of computation. An important characteristic of the TCQ method is quantization of an object signal by using a structured codebook which is constructed based on a signal set expansion concept. By using Ungerboeck's set partition concept, a Trellis coding quantizer uses an extended set of quantization levels, and codes an object signal at a desired transmission bit rate. The Viterbi algorithm is used to encode an object signal. At a transmission rate of R bits per sample, an output level is selected among $2^{R+1}$ levels when encoding each sample.

Figure 2:
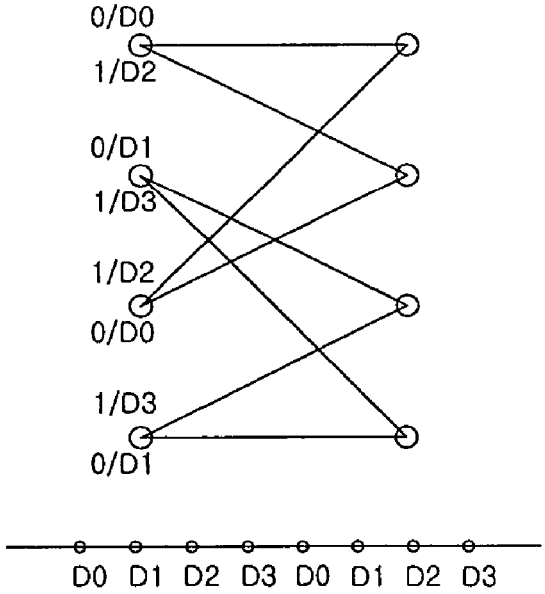
FIG. 2 (PRIOR ART)
FIG. 2 is a diagram showing the Trellis coded quantization (TCQ) structure and output level.

FIG. 2 is a diagram showing an output signal and Trellis structure for an input signal having a uniform distribution when 2 bits are allocated for a sample. Eight output signals are distributed, in an interleaved manner, in the sub-codebooks of D0, D1, D2, and D3, as shown in FIG. 2. When quantization object vector x is given, output signal ($\hat{x}$) minimizing distortion ($d(x,\hat{x})$) is determined by using the Viterbi algorithm, and the output signal ($\hat{x}$) determined by the Viterbi algorithm is expressed using 1-bit/sample information to indicate a corresponding Trellis path and (R−1)-bits/sample information to indicate a codeword determined in the sub-codebook allocated to the corresponding Trellis path. These information bits are transmitted through a channel to a decoder, and the decoding process from the transmitted bit information items will now be explained. The bit indicating Trellis path information is used as an input to a rate-½ convolutional encoder, and the corresponding output bits of the convolutional encoder specify the sub-codebook. Trellis path information requires one bit of path information in each stage and initial state information. The number of additional bits required to express initial state information is $\log_2 N$ when the Trellis has N states.

Figure 3:
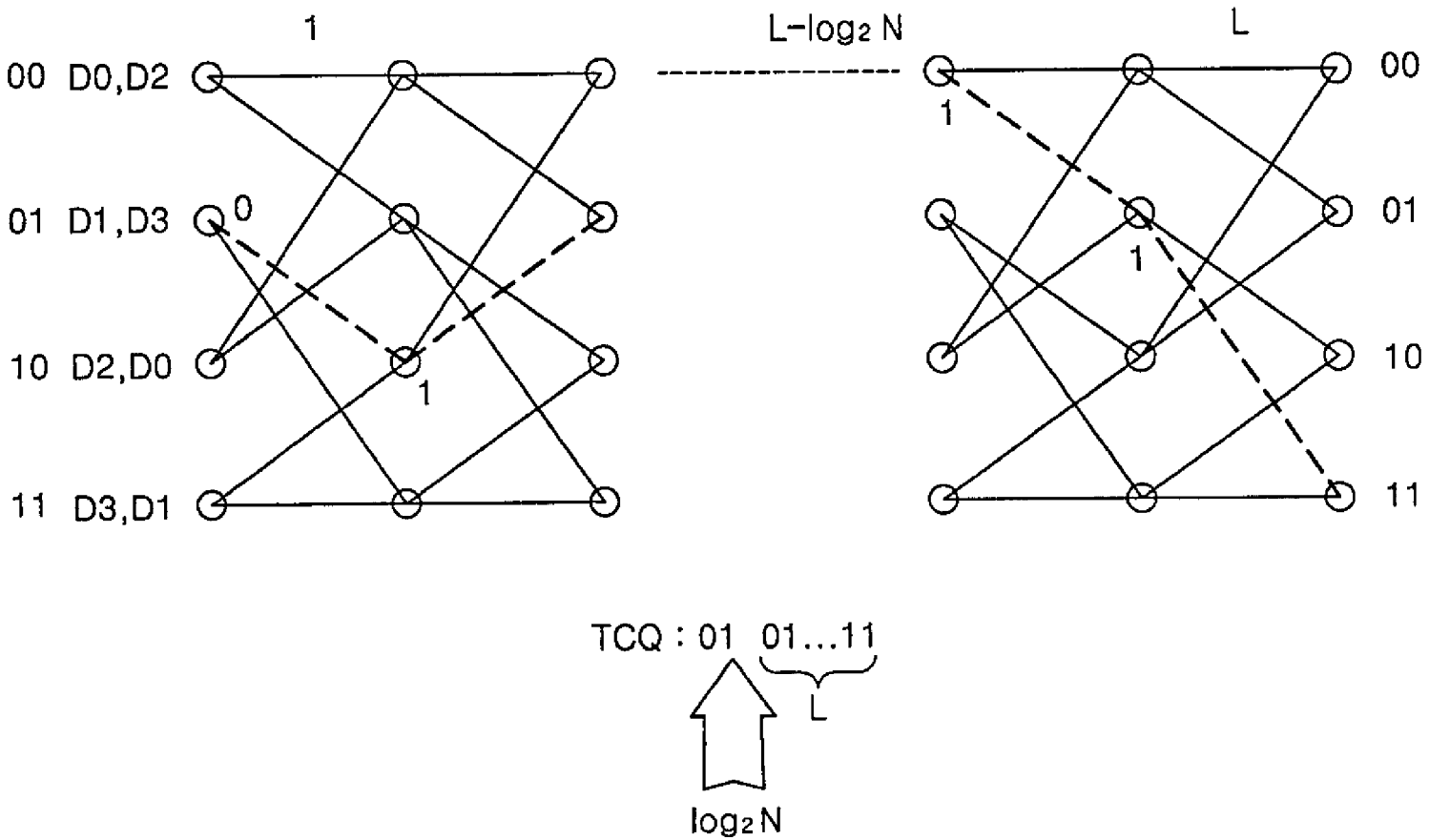
FIG. 3 is a diagram showing the structure of Trellis path information in TCQ.

FIG. 3 is a diagram showing the overhead information of TCQ for a 4-state Trellis structure. In order to transmit Trellis path (thick dotted lines) information determined by the TCQ method, initial state information '01' should be additionally transmitted in addition to L bits of path information to specify L stages. Accordingly, when data is being quantized in units of blocks by the TCQ method, the object signal should be coded by using the remaining available bits excluding $\log_2 N$ bits among entire transmission bits in each block, which is the cause of its performance degradation. In order to solve this problem, Nikneshan and Kandani suggested a tail-biting (TB)-TCQ algorithm. Their algorithm puts constraints on the selection of an initial trellis state and a last state in a Trellis path.

Figure 4:
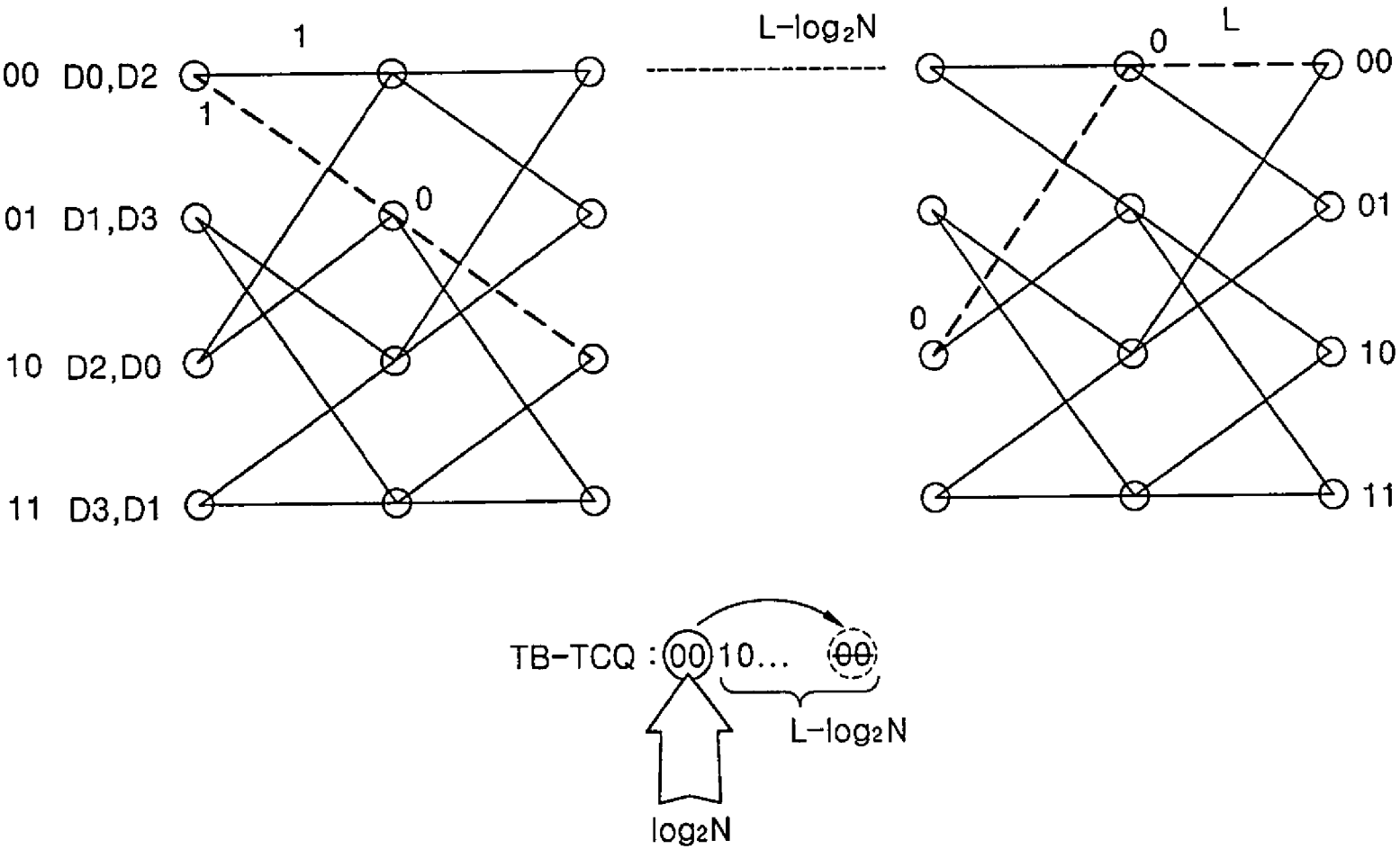
FIG. 4 is a diagram showing the structure of Trellis path information in TB-TCQ.
Figure 5A:
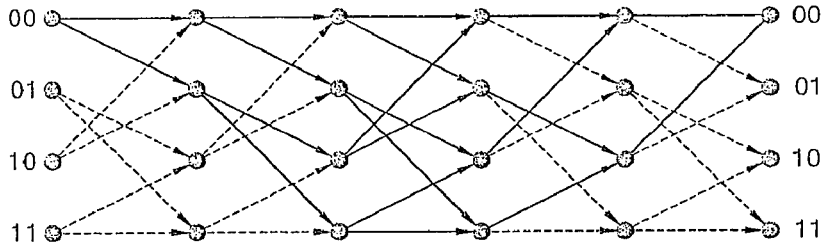
FIGS. 5A-5D are diagrams showing a Trellis path that should be considered in a single Viterbi encoding process according to an initial state when a TB-TCQ algorithm is used in a 4-state Trellis structure.
Figure 5B:
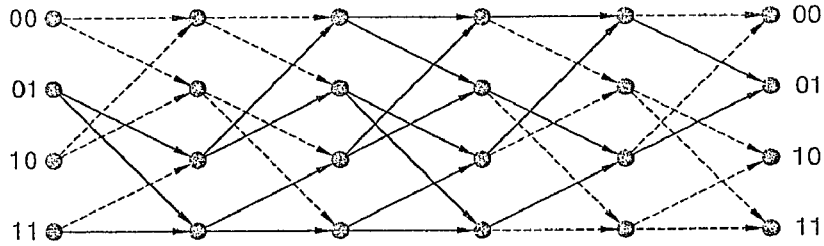
Figure 5C:
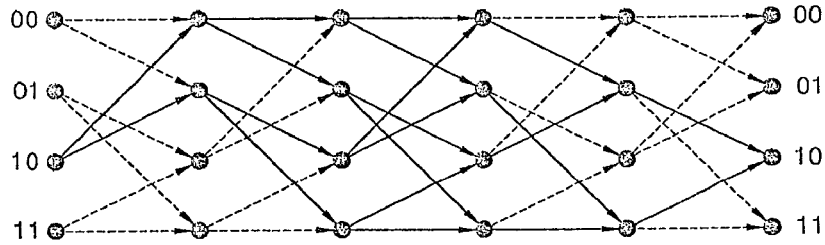
Figure 5D:
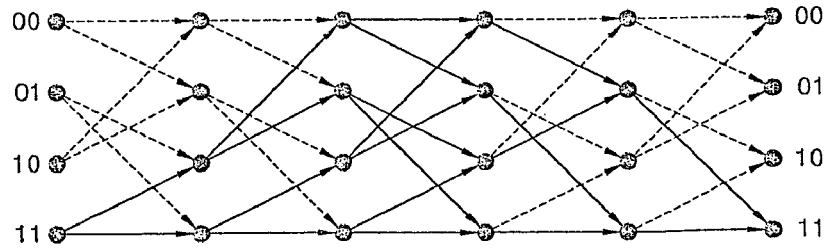

FIG. 4 is a diagram showing a Trellis path (thick dotted lines) quantized and selected by TB-TCQ method suggested by Nikneshan and Kandani. Since transmission of path change information in the last $\log_2 N$ stage is not needed, Trellis path information can be transmitted by using a total of L bits, and additional bits are not needed like the traditional TCQ. That is, the TB-TCQ algorithm suggested by Nikneshan and Kandani solves the overhead problem of the conventional TCQ. However, from a quantization complexity point of view, the single Viterbi encoding process needed by the TCQ should be performed as many times as the number of allowed initial Trellis states. The maximal complexity TB-TCQ method allows all initial states, each pair with a single (nominally the same) final state, and therefore the complexity is obtained by multiplying that of TCQ by the number of trellis states. For example, FIGS. 5A-5D are diagrams showing Trellis paths (thick solid lines) that can be selected in each of a total of four Viterbi encoding processes in order to find an optimal Trellis path by using TB-algorithm suggested by Nikneshan and Kandani.

Figure 6:
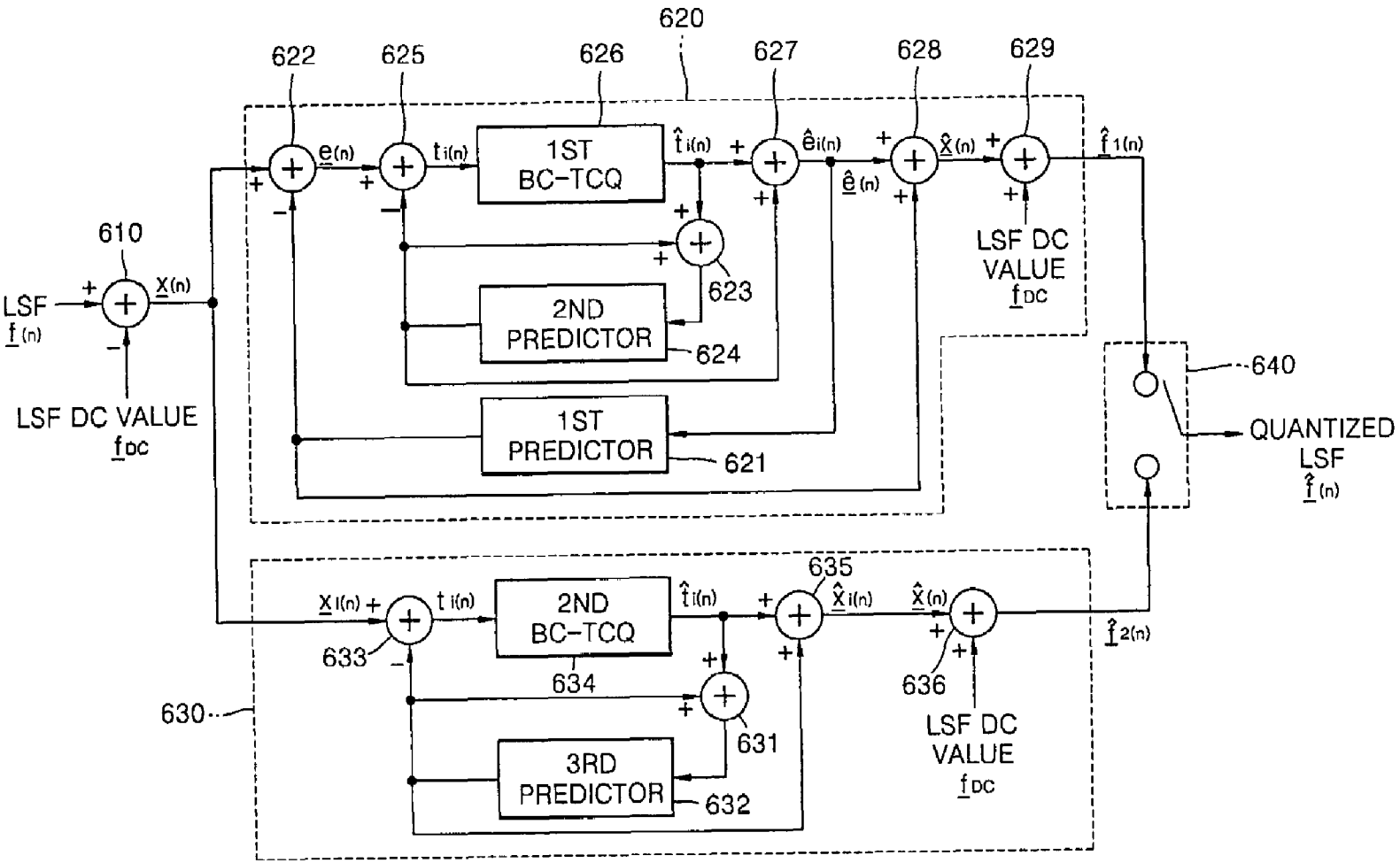
FIG. 6 is a block diagram showing the structure of a line spectral frequency (LSF) coefficient quantization apparatus according to an embodiment of the present invention in a speech coding system.

FIG. 6 is a block diagram showing the structure of a line spectral frequency (LSF) coefficient quantization apparatus according to an embodiment of the present invention in a speech coding system. The LSF coefficient quantization apparatus comprises a first subtracter 610, a memory-based Trellis coded quantization unit 620, a non-memory Trellis coded quantization unit 630 connected in parallel with the memory-based coded quantization unit 620, and a switching unit 640. Here, the memory-based Trellis coded quantization unit 620 comprises a first predictor 621, a second predictor 624, a second subtracter 622, a third subtracter 625, first through fourth adders 623, 627, 628, and 629, and a first block-constrained Trellis coded quantization unit (BC-TCQ) 626. The non-memory coded quantization unit 630 comprises fifth through seventh adders 631, 635, and 636, a fourth subtracter 633, a third predictor 633, and a second BC-TCQ 634.

Referring to FIG. 6, the first subtracter 610 subtracts the DC component ($\underline{f}_{DC}(n)$) of an input LSF coefficient vector ($\underline{f}(n)$) from the LSF coefficient vector and the LSF coefficient vector ($\underline{x}(n)$), in which the DC component is removed, is applied as input to the memory-based Trellis coded quantization unit 620 and the non-memory Trellis coded quantization unit 630 at the same time.

The memory-based Trellis coded quantization unit 620 receives the LSF coefficient vector ($\underline{x}(n)$), in which the DC component is removed, generates prediction error vector ($t_i(n)$) by performing inter-frame prediction and intra-frame prediction, quantizes the prediction error vector ($t_i(n)$) by using the BC-TCQ algorithm to be explained later, and then, by performing intra-frame and inter-frame prediction compensation, generates the quantized and prediction-compensated LSF coefficient vector ($\hat{\underline{x}}(n)$), and provides the final quantized LSF coefficient vector ($\hat{\underline{f}}_1(n)$), which is obtained by adding the quantized and prediction-compensated LSF coefficient vector ($\hat{\underline{x}}(n)$) and the DC component ($\underline{f}_{DC}(n)$) of the LSF coefficient vector, and is applied as input to the switching unit 640.

For this, MA prediction, for example, a fourth-order MA prediction algorithm is applied to the first predictor 621 and the first predictor 621 generates a prediction value obtained from prediction error vectors of previous frames (n−i, here i=1 . . . 4) which are quantized and intra-frame prediction-compensated. The second subtracter 622 obtains prediction error vector ($\underline{e}(n)$) of the current frame (n) by subtracting the prediction value provided by the first predictor 621 from the LSF coefficient vector ($\underline{x}(n)$), in which the DC component is removed.

To the second predictor 624, AR prediction, for example a first-order AR prediction algorithm is applied and the second predictor 624 generates a prediction value obtained by multiplying prediction factor ($\rho_i$) for the i-th element by the (i−1)-th element value ($\hat{e}_{i-1}(n)$) which is quantized by the first BC-TCQ 626 and intra-frame prediction-compensated by the first adder 623. The third subtracter 625 obtains the prediction error vector of i-th element value ($t_i(n)$) by subtracting the prediction value provided by the second predictor 624 from the i-th element value ($e_i(n)$) in prediction error vector ($\underline{e}(n)$) of the current frame (n) provided by the second subtracter 622.

The first BC-TCQ 626 generates the quantized prediction error vector with i-th element value ($\hat{t}_i(n)$), by performing quantization of the prediction error vector with i-th element value ($t_i(n)$), which is provided by the second subtracter 625, by using the BC-TCQ algorithm. The second adder 627 adds the prediction value of the second predictor 624 to the quantized prediction error vector with i-th element value ($\hat{t}_i(n)$) provided by the first BC-TCQ 626, and by doing so, performs intra-frame prediction compensation for the quantized prediction error vector with i-th element value ($\hat{t}_i(n)$) and generates the i-th element value ($\hat{e}_i(n)$) of the quantized inter-frame prediction error vector. The element value of each order forms the quantized prediction error vector ($\hat{\underline{e}}(n)$) of the current frame.

The third adder 628 generates the quantized LSF coefficient vector ($\hat{\underline{x}}(n)$), by adding the prediction value of the first predictor 612 to the quantized inter-frame prediction error vector ($\hat{\underline{e}}(n)$) of the current frame provided by the second adder 627, that is, by performing inter-frame prediction compensation for the quantized prediction error vector ($\hat{\underline{e}}(n)$) of the current frame. The fourth adder 629 generates the quantized LSF coefficient vector ($\hat{\underline{f}}_1(n)$), by adding DC component ($\underline{f}_{DC}(n)$) of the LSF coefficient vector to the quantized LSF coefficient vector ($\hat{\underline{x}}(n)$) provided by the third adder 628. The finally quantized LSF coefficient vector ($\hat{\underline{f}}_1(n)$) is provided to one end of the switching unit 640.

The non-memory Trellis coded quantization unit 630 receives the LSF coefficient vector ($\underline{x}(n)$), in which the DC component is removed, performs intra-frame prediction, generates prediction error vector ($t_i(n)$), quantizes the prediction error vector ($t_i(n)$) by using the BC-TCQ algorithm, which will be explained later, then performs intra-frame prediction compensation, and generates the quantized and prediction-compensated LSF coefficient vector ($\hat{\underline{x}}(n)$). The non-memory Trellis coded quantization unit 630 provides the switching unit 640 with the finally quantized LSF coefficient vector ($\hat{\underline{f}}_2(n)$), which is obtained by adding quantized and prediction-compensated LSF coefficient vector ($\hat{\underline{x}}(n)$) and DC component ($\underline{f}_{DC}(n)$) of the LSF coefficient vector.

For this, AR prediction, for example, a first-order AR prediction algorithm is used in the third predictor 632 and the third predictor 632 generates a prediction value obtained by multiplying prediction element ($\rho_i$) for the i-th element by the intra-frame prediction error vector with (i−1)-th element ($\hat{\underline{x}}_{i-1}(n)$) which is quantized by the second BC-TCQ 634 and then intra-frame prediction-compensated by the fifth adder 631. The fourth subtracter 633 generates the prediction error vector with i-th element ($t_i(n)$) by subtracting the prediction value provided by the third predictor 632 from the i-th element ($x_i(n)$) of the LSF coefficient vector ($\underline{x}(n)$), in which the DC component is removed, provided by the first subtracter 610.

The second BC-TCQ 634 generates the quantized prediction error vector of i-th element value ($\hat{\underline{t}}_i(n)$), by performing quantization of the prediction error vector of i-th element ($t_i(n)$), which is provided by the fourth subtracter 633, by using the BC-TCQ algorithm. The sixth adder 635 adds the prediction value of the third predictor 632 to the quantized prediction error vector of i-th element value ($\hat{t}_i(n)$) provided by the second BC-TCQ 634, and by doing so, performs intra-frame prediction compensation for the quantized prediction error vector of i-th element value ($\hat{\underline{t}}_i(n)$) and generates the quantized and prediction-compensated LSF coefficient vector of i-th element value ($\hat{x}_i(n)$). The LSF coefficient vector of the element values of each order forms the quantized prediction error vector ($\hat{\underline{e}}(n)$) of the current frame. The seventh adder 636 generates the quantized LSF coefficient vector ($\hat{\underline{f}}_2(n)$), by adding the quantized LSF coefficient vector ($\hat{\underline{x}}(n)$) provided by the sixth adder 635 to the DC component ($\underline{f}_{DC}(n)$) of the LSF coefficient vector. The finally quantized LSF coefficient vector ($\hat{\underline{f}}_2(n)$) is provided to one end of the switching unit 640.

Between LSF coefficient vectors ($\hat{\underline{f}}_1(n)$, $\hat{\underline{f}}_2(n)$) quantized in the memory-based Trellis coded quantization unit 620 and the non-memory Trellis coded quantization unit 630, respectively, the switching unit 640 selects one that has a shorter Euclidian distance from the input LSF coefficient vector ($\underline{f}(n)$), and outputs the selected LSF coefficient vector.

In the present embodiment, the fourth adder 629 and the seventh adder 636 are disposed in the memory-based Trellis coded quantization unit 620 and the non-memory Trellis coded quantization unit 630, respectively. In another embodiment, the fourth adder 629 and the seventh adder 636 may be removed and instead, one adder is disposed at the output end of the switching unit 640 so that the DC component ($\underline{f}_{DC}(n)$) of the LSF coefficient vector can be added to the quantized LSF coefficient vector ($\hat{\underline{x}}(n)$) which is selectively output from the switching unit 640.

The BC-TCQ algorithm used in the present invention will now be explained.

The BC-TCQ algorithm uses a rate-½ convolutional encoder and N-state Trellis structure ($N=2^v$, here, v denotes the number of binary state variables in the encoder finite state machine) based on an encoder structure without feedback. As prerequisites for the BC-TCQ algorithm, the initial states of Trellis paths that can be selected are limited to $2^k$ ($0 \leqq k \leqq v$) among the total of N states, and the number of states of the last stage are limited to $2^{v-k}$ ($0 \leqq k \leqq v$) among a total of N states, and dependent on the initial states of the Trellis path.

In the process for performing single Viterbi encoding by applying this BC-TCQ algorithm, the N survivor paths determined under the initial state constraint are found from the first stage to a stage $L-\log_2 N$ (here, L denotes the number of entire stages, and N denotes the number of entire Trellis states. Then, in the encoding over the remaining v stages, only Trellis paths are considered which terminate in a state of the last stage selected among $2^{v-k}$ ($0 \leqq k \leqq v$) states determined according to each initial state. Among the considered Trellis paths, an optimum Trellis path is selected and transmitted.

Figure 7:
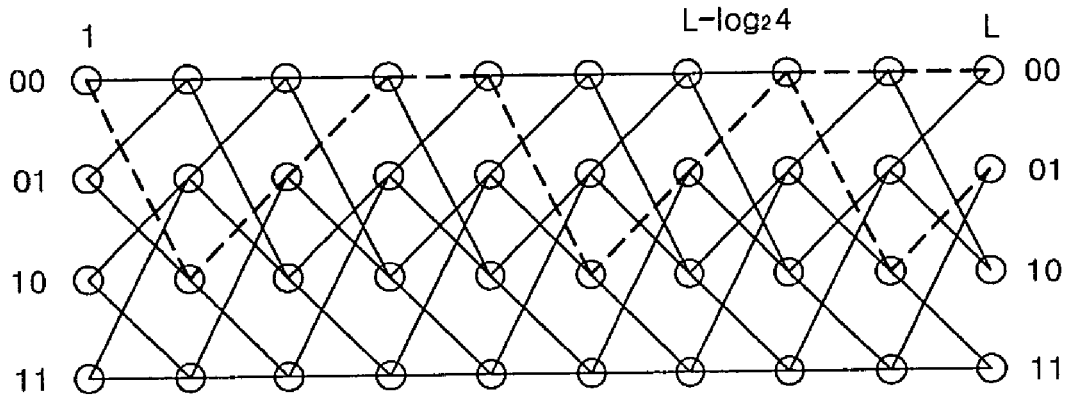
FIG. 7 is a diagram showing Trellis paths that should be considered in a single Viterbi encoding process according to a constrained initial state when a BC-TCQ algorithm is used in a 4-state Trellis structure.

FIG. 7 is a diagram showing Trellis paths that are considered when using the BC-TCQ algorithm with k being 1 and a Trellis structure with a total of 4 states. In this example, constraints are given such that the initial states of Trellis paths that can be selected are '00' and '10' among 4 states, and the state of the last stage is '00' or '01' when the initial state is '00' and '10' or '11' when the initial state is '10'. Referring to FIG. 7, since the initial state of survivor path (thick dotted lines) determined to state '00' in stage $L-\log_2 4$ is '00', Trellis paths that can be selected in the remaining stages are marked by thick dotted lines with the states of the last stage being '00' and '01'.

Next, the BC-TCQ encoding process performed in Trellis paths selected as shown in FIG. 7 in the memory-based Trellis coded quantization unit 620 will now be explained referring to FIG. 8 and FIGS. 10A through 10C.

Figure 8:
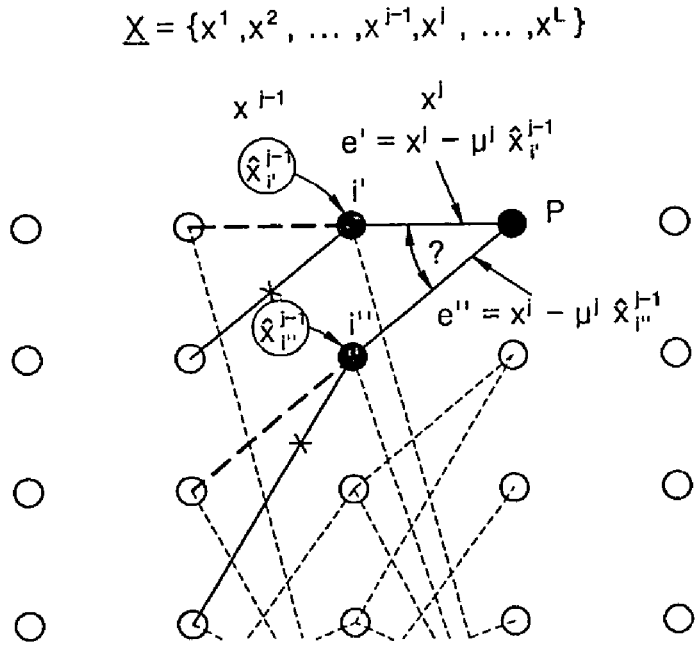
FIG. 8 is a schematic diagram of a Viterbi encoding process in a non-memory Trellis coded quantization unit in FIG. 6.
Figure 10A:
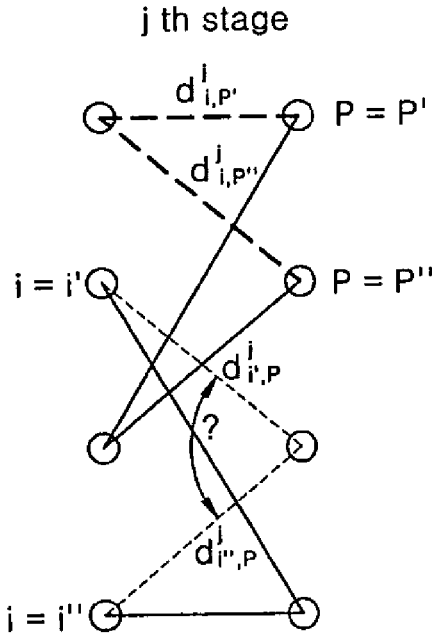
FIGS. 10A through 10C are flowcharts explaining the BC-TCQ encoding process of the non-memory Trellis coded quantization unit in FIG. 6.
Figure 10B:
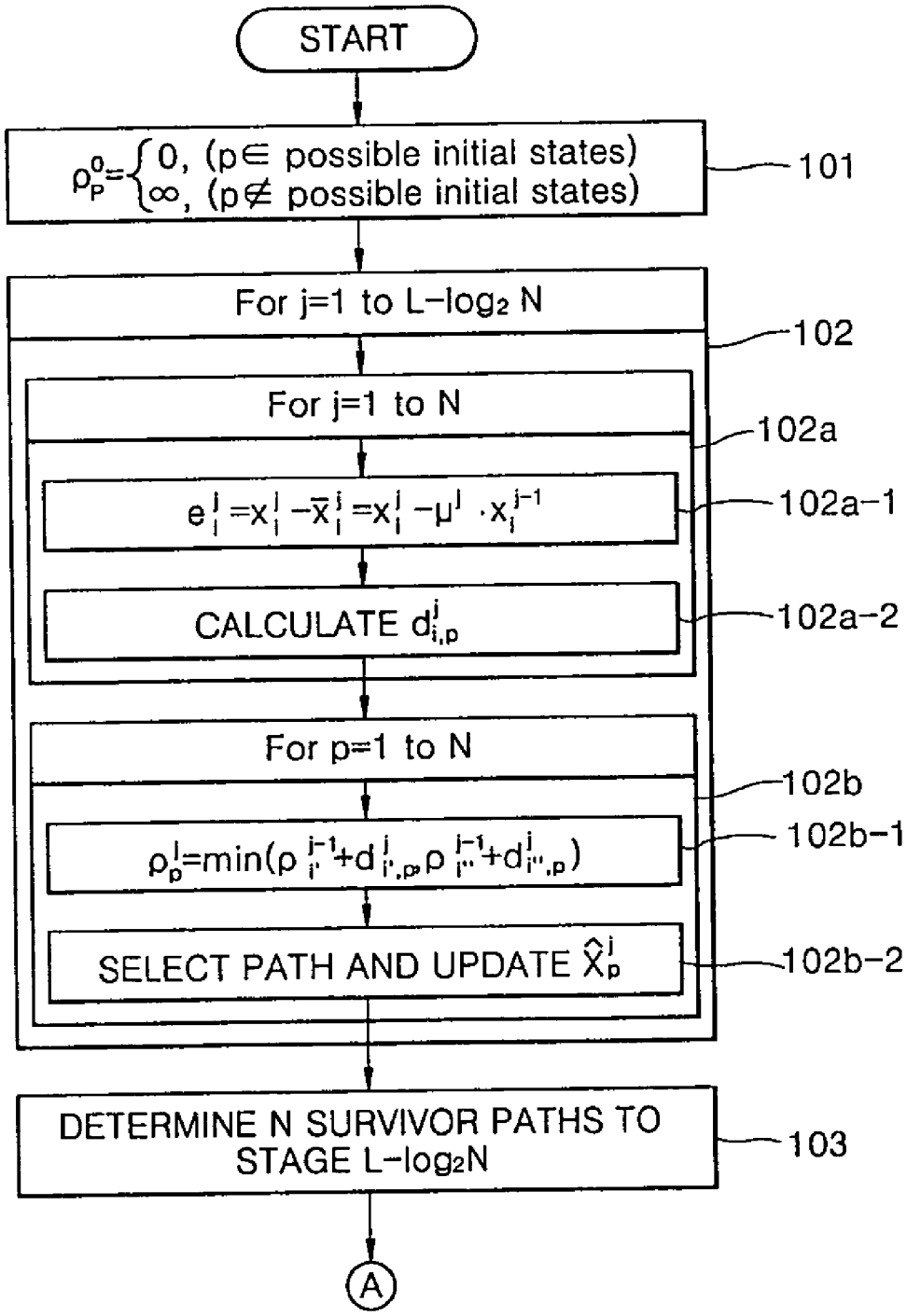
Figure 10C:
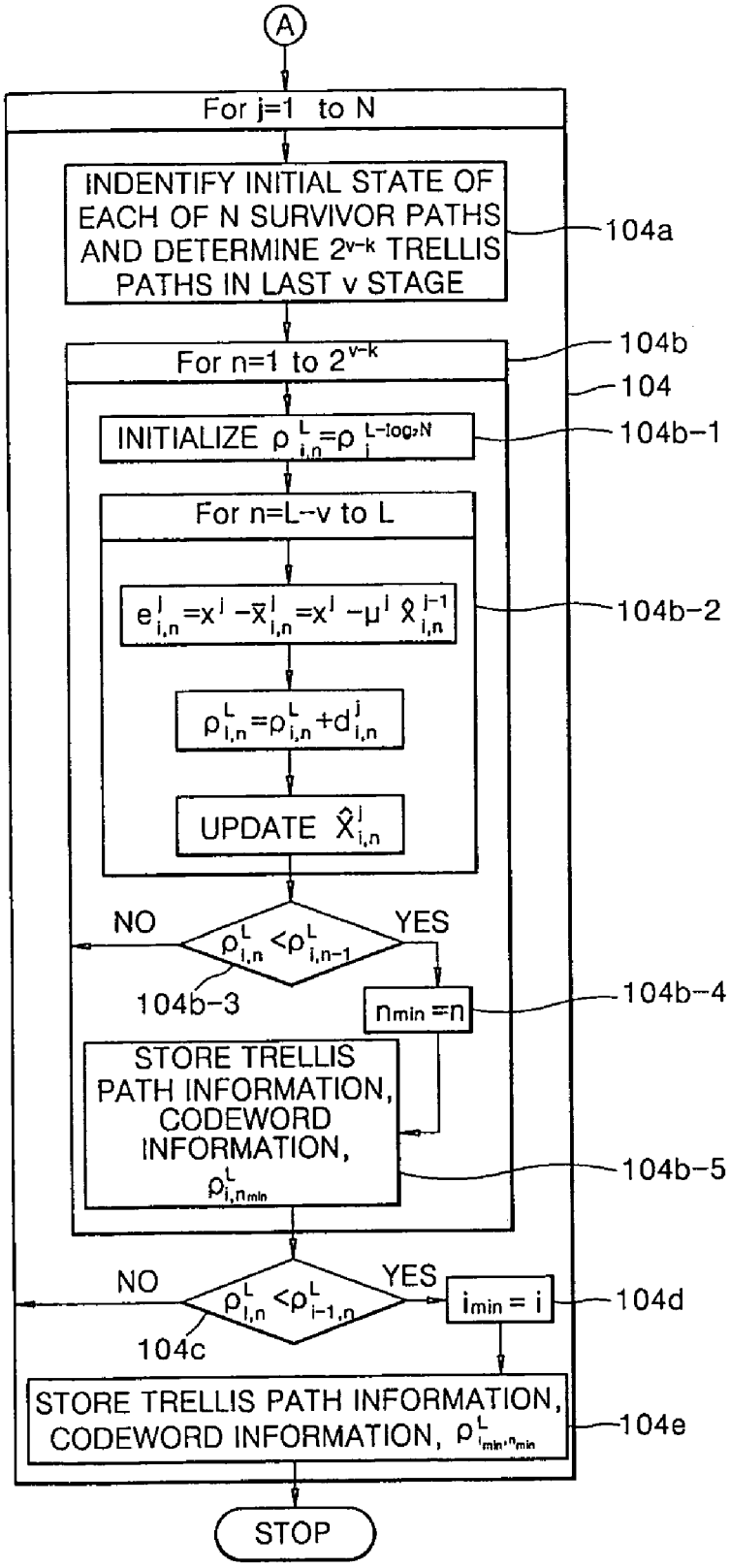

The Viterbi encoding process in the j-th stage in FIG. 8 or FIG. 10A will first be explained. Unlike $x^j$ in BC-TCQ encoding process in the non-memory Trellis coded quantization unit 630, the quantization object signals related to state p of the j-th stage are $e'=x^j-\mu^j\cdot\hat{x}_{i'}^{j-1}$ and $e''=x^j-\mu^j\cdot\hat{x}_{i''}^{j-1}$, and vary depending on the state of the previous stage. This is shown in FIGS. 10A through 10C. In operation 101, initialization of the entire distance ($\rho_p^0$) at state p in stage 0 is performed, and in operations 102 and 103, N survivor paths are determined from the first stage-to-stage $L-\log_2 N$ (here, L denotes the number of entire stages and N denotes the number of entire Trellis states). That is, in operation 102*a*, for N states from the first stage to stage $L-\log_2 N$, quantization distortion ($d_{i',p}$, $d_{i'',p}$) for a quantization object signal obtained by operation 102*a*-1 is obtained as the following equations 1 and 2 by using a corresponding sub-codebook, and stored in distance metric ($d_{i',p}$, $d_{i'',p}$) in operation 102*a*-2:

$$d_{i',p}=\min(d(e',y_{i',p})|y_{i',p}\in D_{i',p}^{j}) \quad (1)$$

$$d_{i'',p}=\min(d(e'',y_{i'',p})|y_{i'',p}\in D_{i'',p}^{j}) \quad (2)$$

In equations 1 and 2, $D_{i',p}^{j}$ denotes a sub-codebook allocated to a branch between state p in the j-th stage and state i' in the (j−1)-th stage, and $D_{i'',p}^{j}$ denotes a sub-codebook allocated to a branch between state p in the j-th stage and state i" in the (j−1)-th stage. Here, $y_{i',p}$ and $y_{i'',p}$ denote code vectors in $D_{i',p}^{j}$ and $D_{i'',p}^{j}$, respectively.

Then, a process for selecting one between two Trellis paths connected to state p in the j-th stage and an accumulated distortion update process are performed as the following equation 3 (operation 102*b*-1 in operation 102*b*):

$$\rho_p^{j}=\min(\rho_{i'}^{j-1}+d_{i',p},\rho_{i''}^{j-1}+d_{i'',p}) \quad (3)$$

Then, when state i' of the previous stage between the two paths is determined, the quantization value for $x^j$ at state p in j-th stage is obtained as the following equation 4 (operation 102*b*-2 in operation 102*b*):

$$\hat{x}_p^{j}=\hat{e}'+\mu^{j}\hat{x}_{i'}^{j-1} \quad (4)$$

Next, in operation 104, in the remaining v stages, the only Trellis paths considered are those for which the state of the last stage is selected among $2^{v-k}$ ($0\leqq k\leqq v$) states determined according to each initial state are considered. For this, in operation 104*a*, the initial state of each of N survivor paths determined as in the operation 103 and $2^{v-k}$ ($0\leqq k\leqq v$) Trellis paths in the last v stages are determined in operation 104*a*.

In operations 104*b* through 104*e*, for each of $2^{v-k}$ ($0\leqq k\leqq v$) states defined according to each initial state value in the entire N survivor paths, information on a Trellis path that has the shortest distance between an input sequence and a quantized sequence in a path determined to the last state, and the codeword information are obtained. In the operations 104*b* through 104*e*, $\rho_{i,n}^{L}$ denotes the entire distance between an input sequence and a quantized sequence in a path determined to the last state (n=1, . . . $2^{v-k}$) in survivor path i, and $d_{i,n}^{j}$ denotes the distance between the quantization value of input sample $x_j$ and the input sample in a path determined to the last state (n=1, . . . $2^{v-k}$) in survivor path i.

Next, the BC-TCQ encoding process performed in Trellis paths selected as shown in FIG. 7 in the non-memory Trellis coded quantization unit 630 will now be explained referring to FIG. 9 and FIGS. 11A through 11C.

Constraints on the initial state and last state are the same as in the BC-TCQ encoding process in the memory-based Trellis coded quantization unit 620, but inter-frame prediction of input samples is not used.

Figure 9:
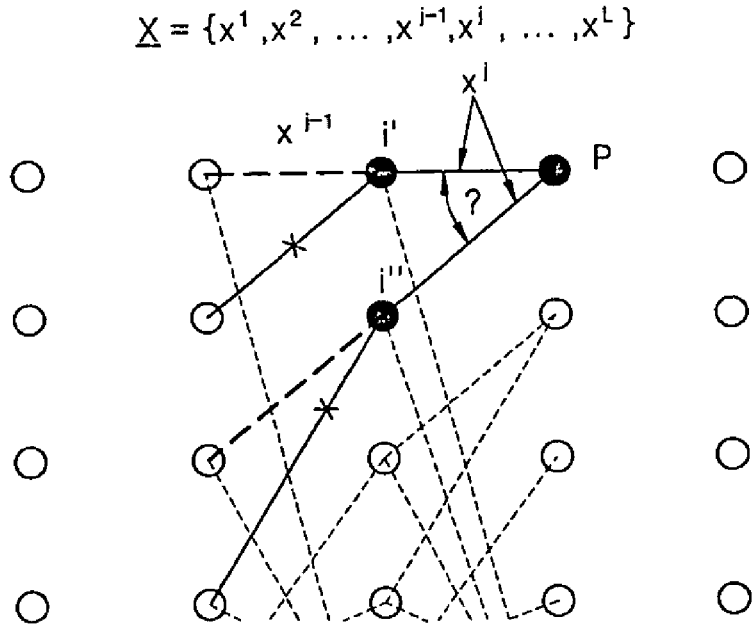
FIG. 9 is a schematic diagram of a Viterbi encoding process in a memory-based Trellis coded quantization unit in FIG. 6.
Figure 11A:
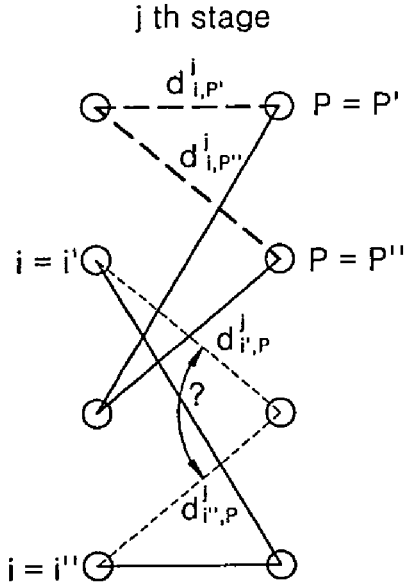
FIGS. 11A through 11C are flowcharts explaining the BC-TCQ encoding process of the memory-based Trellis coded quantization unit in FIG. 6.
Figure 11B:
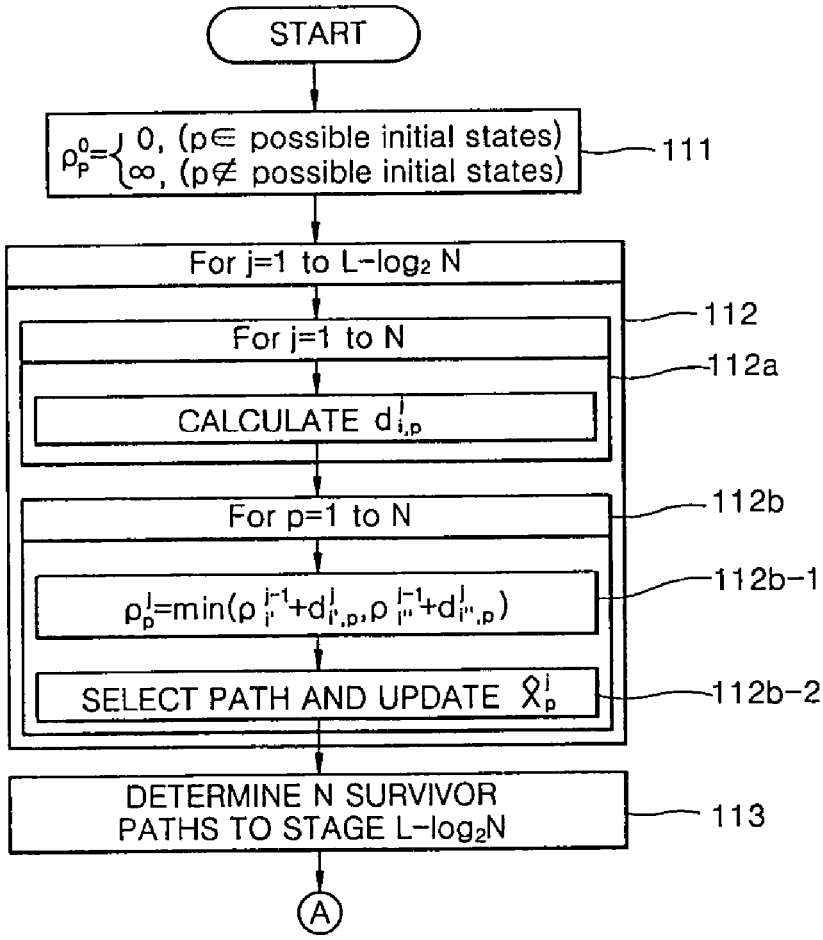
Figure 11C:
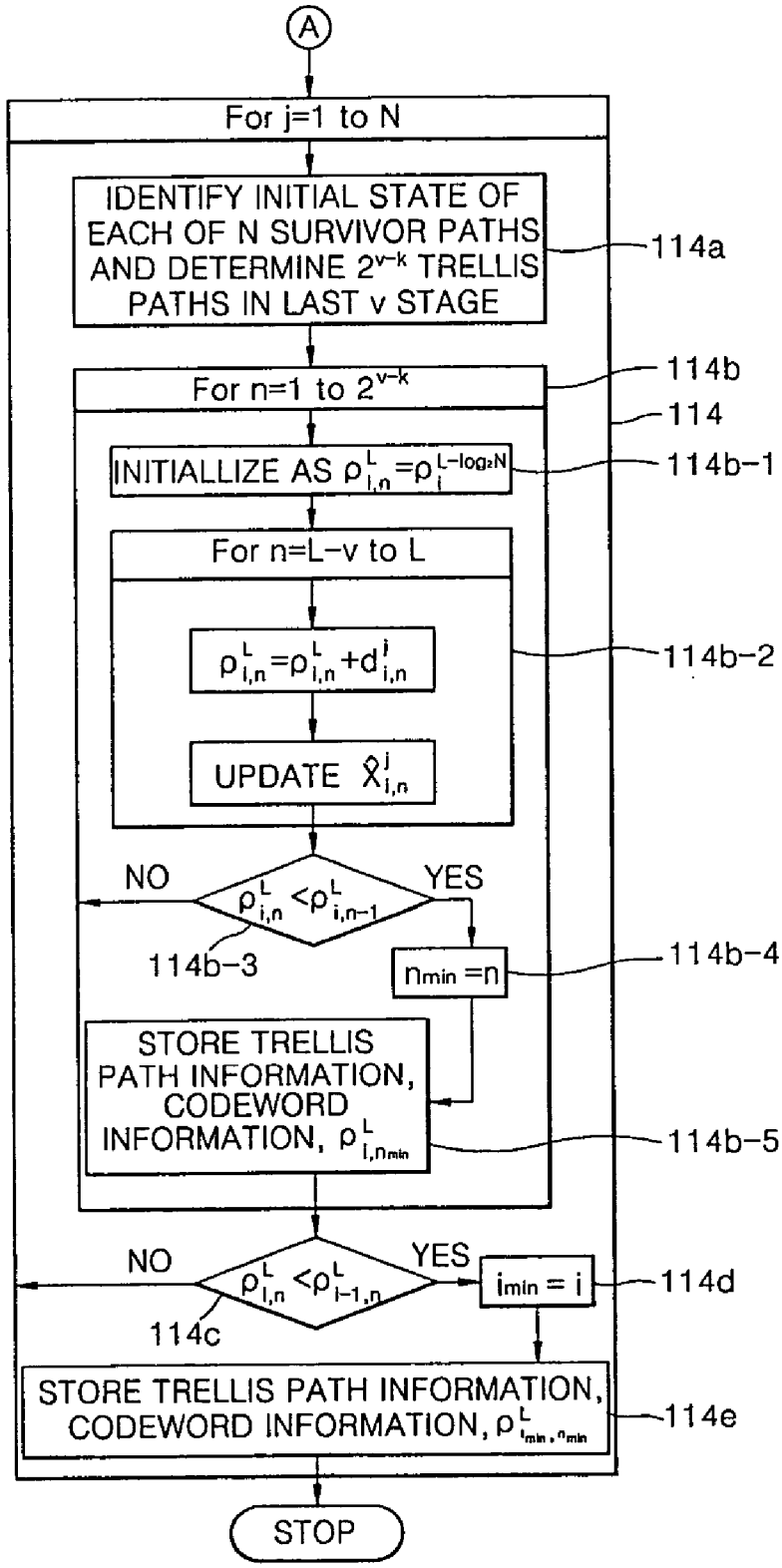

First, the Viterbi encoding process in the j-th stage of FIG. 9 will now be explained, referring to FIGS. 11A through 11C.

In operation 111, initialization of the entire distance ($\rho_p^{0}$) at state p in stage 0 is performed, and in operations 112 and 113, N survivor paths are determined from the first stage-to-stage L-$\log_2$N (here, L denotes the number of entire stages and N denotes the number of entire Trellis states). That is, in operation 112*a*, for N states from the first stage to stage L-$\log_2$N, quantization distortion ($d_{i',p}$, $d_{i'',p}$) is obtained as the equations 5 and 6 by using sub-codebooks allocated to two branches connected to state p in j-th stage, and stored in distance metric ($d_{i',p}$, $d_{i'',p}$):

$$d_{i',p}=\min_{y_{i',p}\in D_{i',p}^{j}}(d(x',y_{i',p})\,|\,y_{i',p}\in D_{i',p}^{j}) \quad (5)$$

$$d_{i'',p}=\min_{y_{i'',p}\in D_{i'',p}^{j}}(d(x'',y_{i'',p})\,|\,y_{i'',p}\in D_{i'',p}^{j}) \quad (6)$$

In equations 5 and 6, $D_{i',p}^{j}$ denotes a sub-codebook allocated to a branch between state p in j-th stage and state i' in (j−1)-th stage, and $D_{i'',p}^{j}$ denotes a sub-codebook allocated to a branch between state p in j-th stage and state i" in (j−1)-th stage. Here, $y_{i',p}$ and $y_{i'',p}$ denote code vectors in $D_{i',p}^{j}$ and $D_{i'',p}^{j}$, respectively.

Then, a process for selecting one among two Trellis paths connected to state p in j-th stage and an accumulated distortion update process are performed as equation 7 and according to the result, a path is selected and $\hat{x}_p^{j}$ is updated (operation 112*b*-1 and 112*b*-2 in operation 112*b*):

$$\rho_p^{j}=\min(\rho_{i'}^{j-1}+d_{i',p},\rho_{i''}^{j-1}+d_{i'',p}) \quad (7)$$

The sequence and functions of the next operation, operation 114, are the same as that of the operation 104 shown in FIG. 10C.

Thus, unlike the TB-TCQ algorithm, the BC-TCQ algorithm according to the present invention enables quantization by a single Viterbi encoding process such that the additional complexity in the TB-TCQ algorithm can be avoided.

Figure 12:
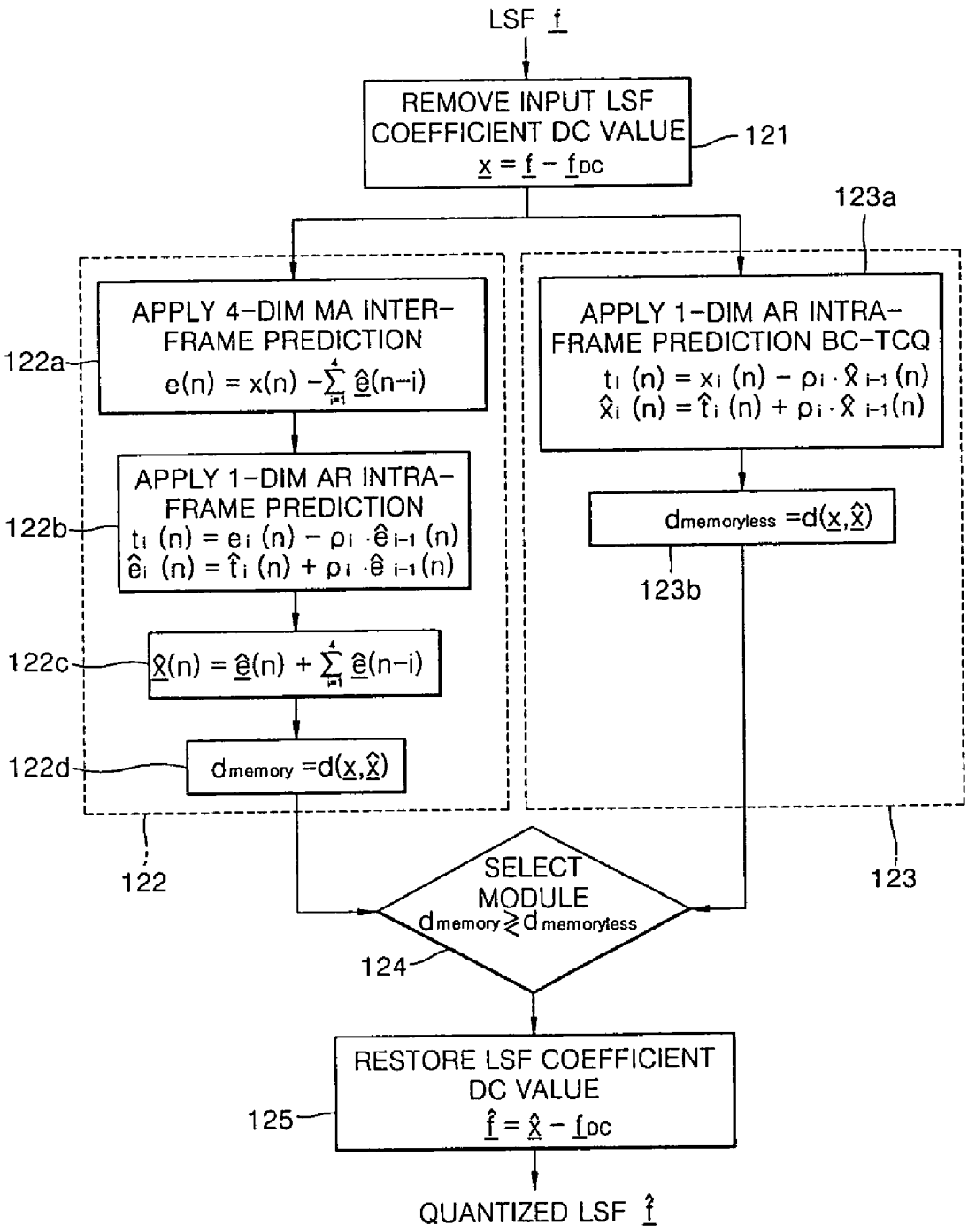
FIG. 12 is a flowchart explaining an LSF coefficient quantization method according to the present invention in a speech coding system.

FIG. 12 is a flowchart explaining an LSF coefficient quantization method according to the present invention in a speech coding system. The method comprises DC component removing operation 121, memory-based Trellis coded quantization operation 122, non-memory Trellis coded quantization operation 123, switching operation 124 and DC component restoration operation 125. Here, DC component restoration operation 125 can be implemented by including the operation into the memory-based Trellis coded quantization operation 122 and the non-memory Trellis coded quantization operation 123.

Referring to FIG. 12, in operation 121, the DC component ($\underline{f}_{DC}(n)$) of an input LSF coefficient vector ($\underline{f}(n)$) is subtracted from the LSF coefficient vector and the LSF coefficient vector ($\underline{x}(n)$) in which the DC component is removed is generated.

In operation 122, the LSF coefficient vector ($\underline{x}(n)$), in which the DC component is removed in the operation 121, is received, and by performing inter-frame and intra-frame predictions, prediction error vector ($t_i(n)$) is generated. The prediction error vector ($t_i(n)$) is quantized by using the BC-TCQ algorithm, and then, by performing intra-frame and inter-frame prediction compensation, quantized LSF coefficient vector ($\hat{\underline{x}}(n)$) is generated, and Euclidian distance ($d_{memory}$) between quantized LSF coefficient vector ($\hat{\underline{x}}(n)$) and the LSF coefficient vector ($\underline{x}(n)$), in which the DC component is removed, is obtained.

The operation 122 will now be explained in more detail. In operation 122*a*, MA prediction, for example, 4-dimensional MA inter-frame prediction, is applied to the LSF coefficient vector ($\underline{x}(n)$), in which the DC component is removed in operation 121, and prediction error vector ($\underline{e}(n)$) of the current frame (n) is obtained. Operation 122*a* can be expressed as the following equation 8:

$$\hat{\underline{e}}(n) = \underline{x}(n) - \sum_{i=1}^{4} \hat{\underline{e}}(n-i) \tag{8}$$

Here, $\hat{\underline{e}}(n-i)$ denotes prediction error vector of the previous frame (n−i, here i=1, . . . 4) which is quantized using the BC-TCQ algorithm and then intra-frame prediction-compensated.

In operation 122*b*, AR prediction, for example, 1-dimensional AR intra-frame prediction, is applied to the i-th element value ($e_i(n)$) in the prediction error vector ($\underline{e}(n)$) of the current frame (n) obtained in operation 122*a*, and prediction error vector ($t_i(n)$) of the i-th element value is obtained. The AR prediction can be expressed as the following equation 9:

$$t_i(n)=e_i(n)-\rho_i\cdot\hat{e}_{i-1}(n) \tag{9}$$

Here, $\rho_i$ denotes the prediction factor of i-th element, and $\hat{e}_{i-1}(n)$ denotes the (i−1)-th element value which is quantized using the BC-TCQ algorithm and then, intra-frame prediction-compensated.

Next, the prediction error vector with i-th element value ($t_i(n)$) obtained by the equation 9 is quantized using the BC-TCQ algorithm and the quantized prediction error vector of i-th element value ($\hat{t}_i(n)$) is obtained. Intra-frame prediction compensation is performed for the quantized prediction error vector with i-th element value ($\hat{t}_i(n)$) and the LSF coefficient vector with i-th element value ($\hat{e}_i(n)$) is obtained. LSF coefficient vector of the element value of each order forms quantized inter-frame prediction error vector ($\hat{\underline{e}}(n)$) of the current frame. The intra-frame prediction compensation can be expressed as the following equation 10:

$$\hat{e}_i(n)=\hat{t}_i(n)+\rho_i\cdot\hat{e}_{i-1}(n) \tag{10}$$

In operation 122*c*, inter-frame prediction compensation is performed for quantized inter-frame prediction error vector ($\hat{\underline{e}}(n)$) of the current frame obtained in the operation 122*b* and quantized LSF coefficient vector ($\hat{\underline{x}}(n)$) is obtained. The operation 122*c* can be expressed as the following equation 11:

$$\hat{\underline{x}}(n) = \hat{\underline{e}}(n) + \sum_{i=1}^{4} \hat{\underline{e}}(n-i) \tag{11}$$

In operation 122*d*, Euclidian distance ($d_{memory}=d(\underline{x},\hat{\underline{x}})$) between quantized LSF coefficient vector ($\hat{\underline{x}}(n)$) obtained in operation 122*c* and the LSF coefficient vector ($\underline{x}(n)$) input in operation 122*a*, in which the DC component is removed, is obtained.

In operation 123, the LSF coefficient vector ($\underline{x}(n)$), in which the DC component is removed in the operation 121, is received, and by performing intra-frame prediction, prediction error vector ($t_i(n)$) is generated. The prediction error vector ($t_i(n)$) is quantized by using the BC-TCQ algorithm and intra-frame prediction compensated, and by doing so, quantized LSF coefficient vector ($\hat{\underline{x}}(n)$) is generated. Euclidian distance ($d_{memoryless}$) between quantized LSF coefficient vector ($\hat{\underline{x}}(n)$) and the LSF coefficient vector ($\underline{x}(n)$), in which the DC component is removed, is obtained.

Operation 123 will now be explained in more detail. In operation 123*a*, AR prediction, for example, 1-dimensional AR intra-frame prediction, is applied to the LSF coefficient vector ($\underline{x}(n)$), with i-th element ($x_i(n)$), in which the DC component is removed in operation 121, and intra-frame prediction error vector with i-th element ($t_i(n)$) is obtained. The AR prediction can be expressed as the following equation 12:

$$t_i(n)=x_i(n)-\rho_i\cdot\hat{x}_{i-1}(n) \tag{12}$$

Here, $\rho_i$ denotes the prediction factor of the i-th element, and $\hat{x}_{i-1}(n)$ denotes intra-frame prediction error vector of the (i−1)-th element which is quantized by BC-TCQ algorithm and then, intra-frame prediction-compensated.

Next, the intra-frame prediction error vector with i-th element ($t_i(n)$) obtained by equation 12 is quantized using the BC-TCQ algorithm and the quantized intra-frame prediction error vector with i-th element ($\hat{t}_i(n)$) is obtained. Intra-frame prediction compensation is performed for the quantized intra-frame prediction error vector with i-th element ($\hat{t}_i(n)$) and the quantized LSF coefficient vector with i-th element value ($\hat{x}_i(n)$) is obtained. The quantized LSF coefficient vector of the element value of each order forms the quantized LSF coefficient vector ($\hat{\underline{x}}(n)$) of the current frame. The intra-frame prediction compensation can be expressed as the following equation 13:

$$\hat{x}_i(n)=\hat{t}_i(n)+\rho_i\cdot\hat{x}_{i-1}(n) \tag{13}$$

In operation 123*b*, Euclidian distance ($d_{memory}=d(\underline{x},\hat{\underline{x}})$) between the quantized LSF coefficient vector ($\hat{\underline{x}}(n)$) obtained in operation 123*a* and LSF coefficient vector ($\underline{x}(n)$) input in the operation 123*a*, in which the DC component is removed, is obtained.

In operation 124, Euclidian distances ($d_{memory}$, $d_{memoryless}$), obtained in operations 122*d* and 123*b*, respectively, are compared and the quantized LSF coefficient vector ($\underline{x}(n)$) with the smaller Euclidian distance is selected.

In operation 125, the DC component ($\underline{f}_{DC}(n)$) of the LSF coefficient vector is added to the quantized LSF coefficient vector ($\hat{\underline{x}}(n)$) selected in the operation 124 and finally the quantized LSF coefficient vector ($\hat{\underline{f}}(n)$) is obtained.

Meanwhile, the present invention may be embodied in a code, which can be read by a computer, on computer readable recording medium. The computer readable recording medium includes all kinds of recording apparatuses on which computer readable data are stored.

The computer readable recording media includes storage media such as magnetic storage media (e.g., ROM's, floppy disks, hard disks, etc.), and optically readable media (e.g., OD-ROMs, DVDs, etc.). Also, the computer readable recording media can be scattered on computer systems connected through a network and can store and execute a computer readable code in a distributed mode. Also, function programs, codes and code segments for implementing the present invention can be easily inferred by programmers in the art of the present invention.

EXPERIMENT EXAMPLES

In order to compare performances of BC-TCQ algorithm proposed in the present invention and the TB-TCQ algorithm, quantization signal-to-noise ratio (SNR) performance for the memoryless Gaussian source (mean 0, dispersion 1) was evaluated. Table 1 shows SNR performance value comparison with respect to block length. Trellis structure with 16 states and a double output level was used in the performance comparison experiment and 2 bits were allocated for each sample. The reference TB-TCQ system allowed 16 initial trellis states, with a single (identical to the initial state) final state allowed for each initial state.

TABLE 1

| Block length | TB-TCQ(dB) | BC-TCQ(dB) |
|---|---|---|
| 16 | 10.53 | 10.47 |
| 32 | 10.70 | 10.68 |
| 64 | 10.74 | 10.76 |
| 128 | 10.74 | 10.82 |

Referring to table 1, when block lengths of the source are 16 and 32, the TB-TCQ algorithm showed the better SNR performance, while when block lengths of the source are 64 and 128, BC-TCQ algorithm showed the better performance.

Table 2 shows complexity comparison between BC-TCQ algorithm proposed in the present invention and TB-TCQ algorithm, when the block length of the source is 16 as illustrated in table 1.

TABLE 2

| Operation | TB-TCQ | BC-TCQ | Remarks |
|---|---|---|---|
| Addition | 5184 | 696 | 86.57% decrease |
| Multiplication | 64 | 64 | — |
| Comparison | 2302 | 223 | 90.32% decrease |

Referring to table 2, in addition and comparison operations, the complexity of the BC-TCQ algorithm according to the present invention greatly decreased compared to that of the TB-TCQ algorithm.

Meanwhile, the number of initial states that can be held in a 16-state Trellis structure is $2^k$ ($0 \leqq k \leqq v$) and table 3 shows comparison of quantization performance for a memoryless Laplacian signal using BC-TCQ when k=0, 1, . . . , 4. The codebook used in the performance comparison experiment has 32 output levels and the encoding rate is 3 bits per sample.

TABLE 3

| | Block length, L | | | |
|---|---|---|---|---|
| Order, k | L = 8 | L = 16 | L = 32 | K = 64 |
| k = 0 | 13.6287 | 14.4819 | 15.1030 | 15.5636 |
| k = 1 | 14.7567 | 15.2100 | 15.5808 | 15.8499 |
| k = 2 | 14.9591 | 15.4942 | 15.7731 | 15.9887 |
| k = 3 | 13.4285 | 14.5864 | 15.3346 | 15.7704 |
| k = 4 | 11.6558 | 13.2499 | 14.4951 | 15.2912 |

Referring to table 3, it is shown that when k=2, the BC-TCQ algorithm has the best performance. When k=2, 4 states of a total 16 states were allowed as initial states in the BC-TCQ algorithm. Table 4 shows initial state and last state information of BC-TCQ algorithm when k=2.

TABLE 4

| Initial states | Last states |
|---|---|
| 0 | 0, 1, 2, 3 |
| 4 | 4, 5, 6, 7 |
| 8 | 8, 9, 10, 11 |
| 12 | 12, 13, 14, 15 |

Next, in order to evaluate the performance of the present invention, voice samples for wideband speech provided by NTT were used. The total length of the voice samples is 13 minutes, and the samples include male Korean, female Korean, male English and female English. In order to compare with the performance of the LSF quantizer S-MSVQ used in 3GPP AMR_WB speech coder, the same process as the AMR_WB speech coder was applied to the preprocessing process before an LSF quantizer, and comparison of spectral distortion (SD) performances, the amounts of computation, and the required memory sizes are shown in tables 5 and 6.

TABLE 5

| | | AMR_WB S-MSVQ | Present invention |
|---|---|---|---|
| SD | Average SD(dB) | 0.7933 | 0.6979 |
| | 2~4 dB (%) | 0.4099 | 0.1660 |
| | >4 dB (%) | 0.0026 | 0 |

TABLE 6

| | | AMR_WB | Present invention | Remarks |
|---|---|---|---|---|
| Computation amount | Addition | 15624 | 3784 | 76% decrease |
| | Multiplication | 8832 | 2968 | 66% decrease |
| | Comparison | 3570 | 2335 | 35% decrease |
| Memory requirement | | 5280 | 1056 | 80% decrease |

Referring to tables 5 and 6, in SD performance, the present invention showed a decrease of 0.0954 in average SD, and a decrease of 0.2439 in the number of outlier quantization areas between 2 dB~4 dB, compared to AMR_WB S-MSVQ. Also, the present invention showed a great decrease in the amount of computation needed in addition, multiplication, and comparison that are required for codebook search, and accordingly, the memory requirement also decreased correspondingly.

According to the present invention as described above, by quantizing the first prediction error vector obtained by inter-frame and intra-frame prediction using the input LSF coefficient vector, and the second prediction error vector obtained in intra-frame prediction, using the BC-TCQ algorithm, the memory size required for quantization and the amount of computation in the codebook search process can be greatly reduced.

In addition, when data analyzed in units of frames is transmitted by using Trellis coded quantization algorithm, additional transmission bits for initial states are not needed and the complexity can be greatly reduced.

Further, by introducing a safety net, error propagation that may take place by using predictors is prevented such that outlier quantization areas are reduced, the entire amount of computation and memory requirement decrease and at the same time the SD performance improves.

Although a few embodiments of the present invention have been shown and described, it will be appreciated by those skilled in the art that changes may be made in these elements without departing from the principles and spirit of the invention, the scope of which is defined in the appended claims and their equivalents.

What is claimed is:

1. A block-constrained (BC)-Trellis coded quantization (TCQ) method comprising:

constraining a number of initial states of Trellis paths available for selection, in a Trellis structure having a total of N ($N=2^v$, here v denotes the number of binary state variables in an encoder finite state machine) states, within $2^k$ ($0 \leqq k \leqq v$) of the total N states, and constraining the number of N states of a last stage within $2^{v-k}$ among the total of N states dependent on the initial states of Trellis paths;

referring to the initial states of Trellis paths determined under the initial state constraint from a first stage to a stage L-$\log_2$N (here, L denotes the number of entire stages and N denotes the total number of the states in the Trellis structure), considering Trellis paths in which an allowed state of the last stage is selected among $2^{v-k}$ states determined by each initial state under the constraint on the state of a last stage by the constraining in remaining v stages; and obtaining an optimum Trellis path among the considered Trellis paths and transmitting the optimum Trellis path.

2. A line spectral frequency (LSF) coefficient quantization method in a speech coding system comprising:

removing a direct current (DC) component in an input LSF coefficient vector;

generating a first prediction error vector by performing inter-frame and intra-frame prediction for the LSF coefficient vector, in which the DC component is removed, quantizing the first prediction error vector by using BC-TCQ algorithm, and then, by performing intra-frame and inter-frame prediction compensation, generating a quantized first LSF coefficient vector;

generating a second prediction error vector by performing intra-frame prediction for the LSF coefficient vector, in which the DC component is removed, quantizing the second prediction error vector by using the BC-TCQ algorithm, and then, by performing intra-frame prediction compensation, generating a quantized second LSF coefficient vector; and selectively outputting a vector having a shorter Euclidian distance to the input LSF coefficient vector between the generated quantized first and second LSF coefficient vectors.

3. The LSF coefficient quantization method of claim 2, further comprising:

obtaining a finally quantized LSF coefficient vector by adding the DC component of the LSF coefficient vector to the quantized LSF coefficient vector selectively output.

4. The LSF coefficient quantization method of claim 2, wherein in the generating of the quantized first LSF coefficient vector, the inter-frame prediction is performed by moving average (MA) filtering and the intra-frame prediction is performed by auto-regressive (AR) filtering.

5. The LSF coefficient quantization method of claim 2, wherein in the generating of the quantized second LSF coefficient vector, the intra-frame prediction is performed by AR filtering.

6. The LSF coefficient quantization method of claim 2, wherein in a Trellis structure having a total of N ($N=2^v$, here v denotes the number of binary state variables in an encoder finite state machine) states, the BC-TCQ algorithm constrains a number of initial states of Trellis paths available for selection, within $2^k$ ($0 \leqq k \leqq v$) of the total of N states, and constrains a number of states of a last stage within $2^{v-k}$ among the total of N states dependent on the initial states of Trellis paths.

7. The LSF coefficient quantization method of claim 6, wherein the BC-TCQ algorithm refers to initial states of Trellis paths determined under the initial state constraint by the constraining from a first stage to stage L-$\log_2$N (here, L denotes the number of entire stages and N denotes the total number of the states in the Trellis structure), and then, in the remaining v stages, considers Trellis paths in which the state of a last stage is selected among $2^{v-k}$ states determined by each initial state under the constraint on the state of a last stage, obtains an optimum Trellis path among the considered Trellis paths, and transmits the optimum Trellis path.

8. An LSF coefficient quantization apparatus in a speech coding system comprising:

a first subtracter removing a DC component in an input LSF coefficient vector and providing the LSF coefficient vector, in which the DC component is removed;

a memory-based Trellis coded quantization unit generating a first prediction error vector by performing inter-frame and intra-frame prediction for the LSF coefficient vector provided by the first subtracter, in which the DC component is removed, quantizing the first prediction error vector using a BC-TCQ algorithm, and by performing intra-frame and inter-frame prediction compensation, generating a quantized first LSF coefficient vector;

a non-memory Trellis coded quantization unit generating a second prediction error vector by performing intra-frame prediction for the LSF coefficient vector, in which the DC component is removed, quantizing the second prediction error vector by using the BC-TCQ algorithm, and by performing intra-frame prediction compensation, generating a quantized second LSF coefficient vector; and a switching unit selectively outputting a vector having a shorter Euclidian distance to the input LSF coefficient vector between the quantized first and second LSF coefficient vectors provided by the memory-based Trellis coded quantization unit and the non-memory-based Trellis coded quantization unit, respectively.

9. The LSF coefficient quantization apparatus of claim 8, wherein the memory-based Trellis coded quantization unit comprises:

a first predictor generating a first prediction value by MA filtering obtained from a sum of quantized and prediction-compensated prediction error vectors of previous frames;

a second subtracter obtaining the prediction error vector of a current frame by subtracting the first prediction value provided by the first predictor from the LSF coefficient vector, in which the DC component is removed;

a second predictor generating a second prediction value by AR filtering obtained from multiplication of the prediction factor of i-th element value by (i−1)-th element value quantized by the BC-TCQ algorithm and then intra-frame prediction compensated;

a third subtracter obtaining the prediction error vector of i-th element value by subtracting the second prediction value provided by the second predictor from i-th element value of the prediction error vector of the current frame provided by the second subtracter;

a first BC-TCQ obtaining the quantized prediction error vector of i-th element value by quantizing the prediction error vector of i-th element value provided by the third subtracter according to the BC-TCQ algorithm; and a first prediction compensation unit performing inter-frame prediction compensation by adding the second prediction value of the second predictor to the quantized prediction error vector of i-th element value provided by the first BC-TCQ and adding the first prediction value of the first predictor to the addition result.

10. The LSF coefficient quantization apparatus of claim 9, wherein the memory-based Trellis coded quantization unit further comprises:

an adder obtaining a quantized first LSF coefficient vector by adding the DC component of the LSF coefficient vector to the quantized LSF coefficient vector selectively output from the first prediction compensation unit.

11. The LSF coefficient quantization apparatus of claim 8, wherein the non-memory Trellis coded quantization unit comprises:

a third predictor generating a third prediction value by AR filtering obtained from multiplication of the prediction factor of i-th element value by the intra-frame prediction error vector of (i−1)-th element value quantized by the BC-TCQ algorithm and then intra-frame prediction compensated;

a fourth subtracter obtaining the prediction error vector of i-th element value by subtracting the third prediction value provided by the third predictor from the LSF coefficient vector of i-th element value of the LSF coefficient vector, in which the DC component is removed, provided by the first subtracter;

a second BC-TCQ obtaining the quantized prediction error vector of i-th element value by quantizing the prediction error vector of i-th element value provided by the fourth subtracter according to the BC-TCQ algorithm; and a second prediction compensation unit performing intra-frame prediction compensation for the quantized prediction error vector of i-th element value, by adding the third prediction value of the third predictor to the quantized prediction error vector of i-th element value provided by the second BC-TCQ.

12. The LSF coefficient quantization apparatus of claim 11, wherein the non-memory Trellis coded quantization unit further comprises:

an adder obtaining a quantized second LSF coefficient vector by adding the DC component of the LSF coefficient vector to the quantized LSF coefficient vector selectively output from the second prediction compensation unit.

13. The LSF coefficient quantization apparatus of claim 8, further comprising:

an adder obtaining a final quantized LSF coefficient vector by adding the DC component of the LSF coefficient vector to the quantized LSF coefficient vector selectively output from the switching unit.

14. The LSF coefficient quantization apparatus of claim 8, wherein in a Trellis structure having a total of N ($N=2^v$, here v denotes the number of binary state variables in an encoder finite state machine) states, the BC-TCQ algorithm constrains a number of initial states of Trellis paths available for selection, within $2^k$ ($0 \leqq k \leqq v$) of the total of N states, and constrains the number of states of a last stage within $2^{v-k}$ among the total of N states dependent on the number of initial states of Trellis paths.

15. The LSF coefficient quantization apparatus of claim 14, wherein the BC-TCQ algorithm obtains Trellis paths by constraining a number of the states from a first stage to a stage $L-\log_2 N$ (here, L denotes the number of entire stages and N denotes the total number of the states in the Trellis structure), and then, in remaining v stages, considers Trellis paths among the constrained number of states of the last stage, obtains an optimum Trellis path among the considered Trellis paths, and transmits the optimum Trellis path.

16. A computer readable recording medium storing computer readable code that when executed by a processor causes a computer to execute a method of block-constrained (BC)-Trellis coded quantization (TCQ) performed by a computer, the method comprising:

constraining a number of initial states of Trellis paths available for selection, in a Trellis structure having a total of N ($N=2^v$, here v denotes the number of binary state variables in an encoder finite state machine) states, within $2^k$ ($0 \leqq k \leqq v$) of the total N states, and constraining the number of N states of a last stage within $2^{v-k}$ among the total of N states dependent on the initial states of Trellis paths;

referring to the initial states of Trellis paths determined under the initial state constraint from a first stage to a stage $L-\log_2 N$ (here, L denotes the number of entire stages and N denotes the total number of the states in the Trellis structure), considering Trellis paths in which an allowed state of the last stage is selected among $2^{v-k}$ states determined by each initial state under the constraint on the state of a last stage by the constraining in remaining v stages; and obtaining an optimum Trellis path among the considered Trellis paths and transmitting the optimum Trellis path.

17. The recording medium of claim 16, wherein the medium is one of a magnetic storage medium and an optical readable medium.

18. A computer readable recording medium storing computer readable code that when executed by a processor causes a computer to execute a method of line spectral frequency (LSF) coefficient quantization in a speech coding system, the method comprising:

removing a direct current (DC) component in an input LSF coefficient vector;

generating a first prediction error vector by performing inter-frame and intra-frame prediction for the LSF coefficient vector, in which the DC component is removed, quantizing the first prediction error vector by using BC-TCQ algorithm, and then, by performing intra-frame and inter-frame prediction compensation, generating a quantized first LSF coefficient vector;

generating a second prediction error vector by performing intra-frame prediction for the LSF coefficient vector, in which the DC component is removed, quantizing the second prediction error vector by using the BC-TCQ algorithm, and then, by performing intra-frame prediction compensation, generating a quantized second LSF coefficient vector; and selectively outputting a vector having a shorter Euclidian distance to the input LSF coefficient vector between the generated quantized first and second LSF coefficient vectors.

19. The recording medium of claim 18, wherein the medium is one of a magnetic storage medium and an optical readable medium.

20. A quantization method in a speech coding system comprising:

quantizing a first prediction vector obtained by inter-frame and intra-frame prediction using an input LSF coefficient vector, and a second prediction error vector obtained in intra-frame prediction, using a block-constrained (BC)-Trellis coded quantization (TCQ) algorithm, reducing memory size required for quantization and computation amount in a codebook search process.

21. The method of claim 20, wherein when data analyzed in units of frames is transmitted using the Trellis coded quantization (TCQ) algorithm additional transmission bits for initial states are not needed, reducing computational complexity.

* * * * *